US009173446B2

(12) United States Patent
Wreede

(10) Patent No.: US 9,173,446 B2
(45) Date of Patent: Nov. 3, 2015

(54) DECORATIVE DEVICE FOR THONG SANDAL

(71) Applicant: Monica Marie Wreede, Delphos, OH (US)

(72) Inventor: Monica Marie Wreede, Delphos, OH (US)

( * ) Notice: Subject to any disclaimer, the term of this patent is extended or adjusted under 35 U.S.C. 154(b) by 0 days.

(21) Appl. No.: 14/452,557

(22) Filed: Aug. 6, 2014

(65) Prior Publication Data

US 2015/0075035 A1 Mar. 19, 2015

Related U.S. Application Data

(63) Continuation-in-part of application No. 13/135,289, filed on Jul. 1, 2011, now abandoned.

(51) Int. Cl.

| | |
|---|---|
| ***A43B 3/12*** | (2006.01) |
| ***A43B 23/24*** | (2006.01) |
| ***A43C 19/00*** | (2006.01) |

(52) U.S. Cl.

CPC ..... *A43B 3/126* (2013.01); *A43B 23/24* (2013.01); *A43C 19/00* (2013.01)

(58) Field of Classification Search

CPC ..... A43B 3/12; A43B 3/126; A43B 23/24; A43C 19/00

USPC ..... 36/11.5, 136

See application file for complete search history.

(56) References Cited

U.S. PATENT DOCUMENTS

| | | | | |
|---|---|---|---|---|
| 93,624 | A * | 8/1869 | Kennedy | 2/151 |
| 2,641,766 | A * | 6/1953 | Taborski | 2/151 |
| 2,681,525 | A * | 6/1954 | James | 428/5 |
| 3,011,281 | A * | 12/1961 | King | 36/11.5 |
| 3,022,515 | A * | 2/1962 | Bornstein et al. | 2/151 |
| 4,864,736 | A * | 9/1989 | Bierk | 36/11.5 |
| 5,042,113 | A * | 8/1991 | Severson et al. | 24/16 PB |
| 6,769,204 | B1 * | 8/2004 | Phillips | 36/136 |
| 7,328,528 | B2 * | 2/2008 | Caminiti | 36/136 |
| 7,343,649 | B2 * | 3/2008 | Walters, Jr. | 24/298 |
| 2010/0011623 | A1 * | 1/2010 | Seckler et al. | 36/136 |
| 2010/0014045 | A1 * | 1/2010 | MacCallum | 351/52 |
| 2010/0058619 | A1 * | 3/2010 | Ferrante et al. | 36/136 |
| 2011/0035965 | A1 * | 2/2011 | Kay | 36/136 |
| 2011/0041363 | A1 * | 2/2011 | Stanfield et al. | 36/136 |
| 2011/0047843 | A1 * | 3/2011 | Russo et al. | 40/636 |
| 2011/0225851 | A1 * | 9/2011 | Nelson | 36/136 |
| 2013/0000145 | A1 * | 1/2013 | Wreede | 36/11.5 |
| 2013/0118041 | A1 * | 5/2013 | Nearing | 36/136 |

* cited by examiner

*Primary Examiner* — Marie Bays

(57) ABSTRACT

A device for removable securing decorative objects to a thong type sandal and a sandal system incorporating such a device.

4 Claims, 4 Drawing Sheets

DECORATIVE DEVICE FOR THONG SANDAL

BACKGROUND OF THE INVENTION

The present invention relates to decorative items for footwear. A need exists for a simple device that is readily adaptable for a variety of decorative objects, is low cost, and easy to use.

SUMMARY OF THE INVENTION

The present invention provides a device that is attached to the straps of a thong-type sandal at the point where the straps join to the thong. The invention present is a flexible, durable device that is repeatedly removable and re-attachable which may incorporate a decorative element or allow attachment of a decorative element.

BRIEF DESCRIPTION OF THE SEVERAL DRAWINGS

FIGS. 4*a* through 4*d* are drawings of the invention showing the attachment process.

Figure 5:
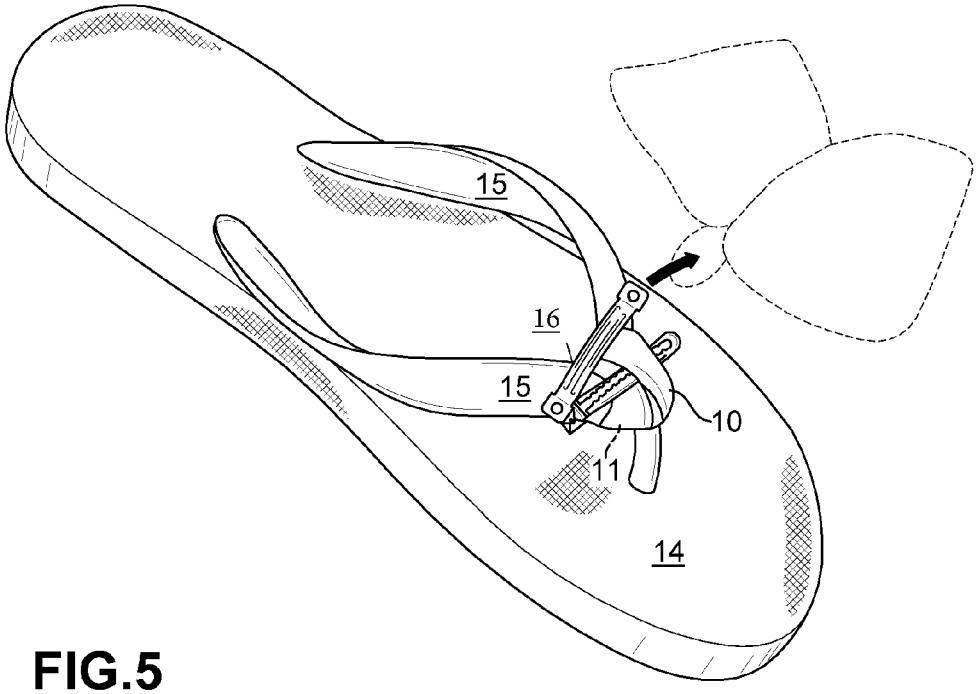

FIG. 5 is a drawing showing how a decoration is attached to the invention using a clip, the decorating shown in dotted lines.

DETAILED DESCRIPTION OF THE INVENTION

Figure 1:
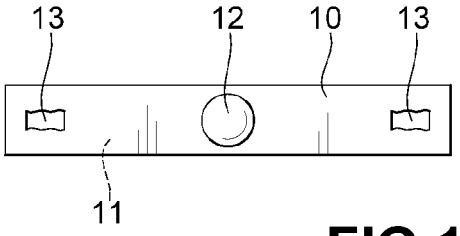
FIG. 1 is a plan view of the invention.

Referring to FIG. 1, the device 10 and it's components can be seen. The device 10 comprises a longitudinally extending strap 11 and a centrally located button, 12. The strap 11 has at least one opening 13 along it's length located to either side of the button 12. The strap 11 is made form a flexible material such as elastic banding, cloth or leather. The strap 11 may be provided with plurality of openings 13 along it's length to provide for adjustment and accommodate sandal straps of different sizes. The strap 11 may also be constructed to include decoration on the strap itself such as sequins, embroidery or printing. The device 10 is removable and re-attachable so that it may be taken off and transferred between shoes or to facilitate washing. In the preferred embodiment the device 10 is constructed of materials that are washable and may be immersed in water without damage.

Figure 2:
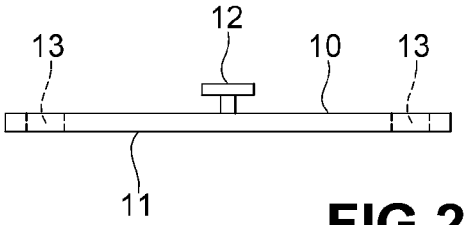
FIG. 2 is a side view of the invention.
Figure 3:
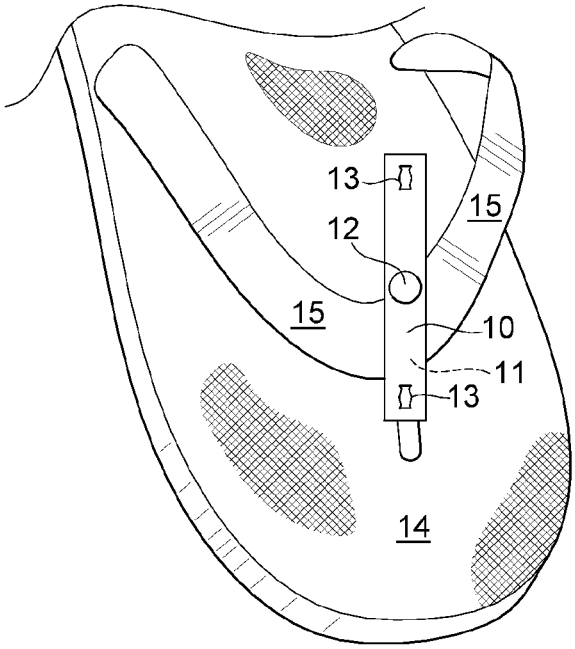
FIG. 3 is a view of the invention being attached to a sandal.
Figure 4A:
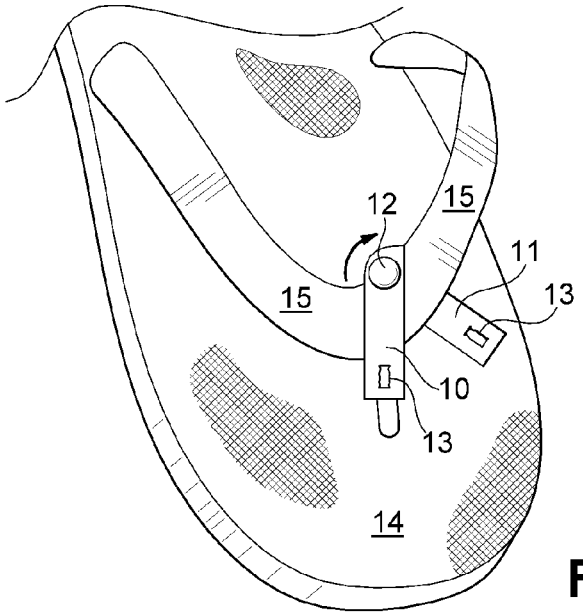
Figure 4B:
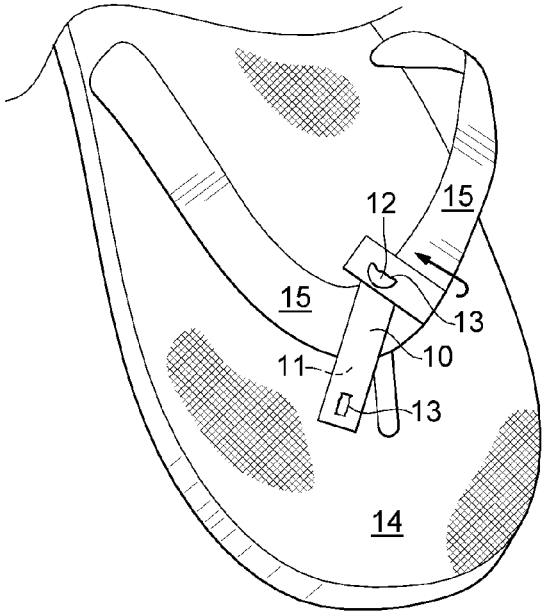
Figure 4C:
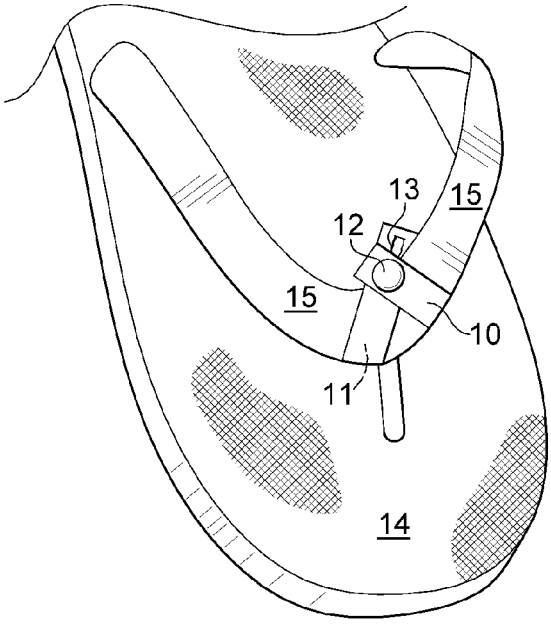
Figure 4D:
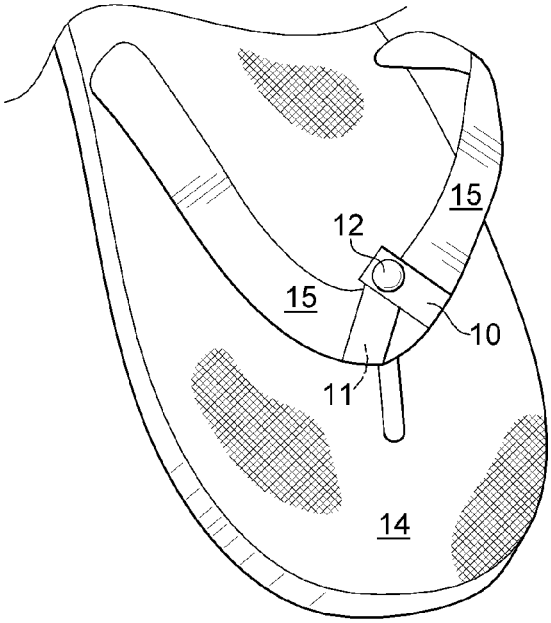

Referring to FIG. 2, the device 10 can be seen in a side view. The button 12 is centrally located on strap 11. The button 12 may be attached by any means to the strap 11 as long as there is sufficient clearance between the attachment point and the circumference of the button 12 so that the opening 13 in the ends of the strap 11 may be placed over the button 12 and secure against its underside. In the preferred embodiment of the invention the strap 11 is made from a stretchy elastic material. The button 12 may be a utilitarian device such as a plain button, or it may incorporate a design itself.

Referring to FIGS. 3 and 4*a* through 4*d*, the device 10 can be seen as installed on a sandal 14. Each side of the strap 11 is wound around a side strap of the sandal 15, the straps 15 attaching to the sandal at the front and back in the normal fashion, and secured by inserting the button 12 through the opening 13. The device 10 then serves to provide a structure to secure a decoration to the sandal 14.

Referring to FIG. 5, a clip 16 is shown which is used to secure a decorative object to the device 10. The clip 16 has an upper arm and a lower arm that are joined with a hinge at one end and are open at the other end, allowing the upper arm of the clip to be placed through a loop on the decorative object. The open end of the clip 16 is provided with means for securing the upper and lower arms together such as a snap. The clip 16 as shown is a barrette such as the type used to hold women's hair in place. Barrettes come in many decorative designs and the use of a barrette will accentuate the attractiveness of the device 10. Although a barrette is shown in the preferred embodiment of the device 10, any number of devices can be used to secure the decorative object to the device 10 such as a safety pin, a length of ribbon which could be tied in a decorative bow, or a length of elastic material having the mating parts of a snap at either end. The device 10, as previously recited, is made from a flexible or elastic material that allows sufficient room for a may be secured to the device 10 by sliding a pin or clip between the strap 11 of the device 10, and the side straps of the sandal.

The invention having been completely described, what is claimed is:

1. A sandal configuration providing a repeatedly removable and attachable device for securing a decoration comprising:

A lower oblong sole portion proportioned to extend a limited nearly equal distance beyond a periphery of a human foot having an upper cushioned surface, A bottom durable traction providing surface, An upwardly positioned shaft of a flexible and smooth material positioned on a toe portion of said sole so that said shaft may comfortably be positioned between the big toe second toe of a human foot, said shaft having a lower end with means for securing it to said sole and an upper end having a plurality of flexible straps attached thereto, said straps extending to a rearward portion of said sole with at least one strap extending rearward on either side of a human foot when a foot is placed in said sandal, said straps having means for attachment to said rearward portion of said sole, said sandal configuration further having means for securing a decorative device to said flexible straps of said sandal comprising:

A single elongated strap of a flexible elastic material having a plurality of openings therethrough equidistantly disposed on either side of a center portion of said elongated strap, said strap of flexible elastic material having a design incorporated along its length, A centrally located button non-removably attached to an upward surface of said elongated strap, said button having an upper surface and a lower surface and attached to said elongated strap such that said lower surface has a free periphery disposed to accept and retain said elongated strap when said button is disposed through said openings, said button having a decorative element incorporated upon a top surface, A repeatedly removable and re-attachable decoration having means for attachment to said elongated strap, and A clip comprising an upper arm and a lower arm, said arms connected at a first end with a hinge and having an open second end that is repeatedly openable and closable so that said arms may secure said decoration therebetween.

2. The device of claim 1 wherein said clip is a barrette.

3. The device of claim 1 wherein said clip is a decorative safety pin.

4. The device of claim 1 wherein said clip is a decorative length of ribbon.

* * * * *